US010214005B2

(12) United States Patent
Bagnoli et al.

(10) Patent No.: US 10,214,005 B2
(45) Date of Patent: Feb. 26, 2019

(54) APPARATUS AND METHOD FOR CHANGING A BLADE OF A ROTARY DIE CUTTER, PARTICULARLY FOR FLEXOGRAPHIC PRINTING MACHINES

(71) Applicant: Bobst Firenze S.r.l., Florence (IT)

(72) Inventors: Ugo Bagnoli, Florence (IT); Federico D'Annunzio, Florence (IT); Giacomo MacCalli, Lodi (IT); Mauro MacCalli, Lodi (IT)

(73) Assignee: BOBST FIRENZE S.R.L. (IT)

( * ) Notice: Subject to any disclaimer, the term of this patent is extended or adjusted under 35 U.S.C. 154(b) by 0 days.

(21) Appl. No.: 15/510,023

(22) PCT Filed: Sep. 23, 2015

(86) PCT No.: PCT/IB2015/057332

§ 371 (c)(1),
(2) Date: Mar. 9, 2017

(87) PCT Pub. No.: WO2016/046764

PCT Pub. Date: Mar. 31, 2016

(65) Prior Publication Data

US 2017/0313055 A1 Nov. 2, 2017

(30) Foreign Application Priority Data

Sep. 24, 2014 (IT) ..... MI2014A1654

(51) Int. Cl.

| | |
|---|---|
| ***B41F 19/00*** | (2006.01) |
| ***B26D 5/00*** | (2006.01) |
| ***B26D 7/27*** | (2006.01) |
| ***B41G 7/00*** | (2006.01) |
| ***B26D 7/26*** | (2006.01) |
| ***B26F 1/44*** | (2006.01) |
| ***B41F 5/24*** | (2006.01) |

(52) U.S. Cl.

CPC ..... *B41F 19/008* (2013.01); *B26D 5/007* (2013.01); *B26D 7/2614* (2013.01); *B26D 7/27* (2013.01);

(Continued)

(58) Field of Classification Search

CPC ..... B41F 5/24; B41F 27/02; B41F 27/005; B41F 27/06; B41F 27/12; B41F 27/105;

(Continued)

(56) References Cited

U.S. PATENT DOCUMENTS

| | | | | |
|---|---|---|---|---|
| 4,923,567 A * | 5/1990 | Liedes | D21G 9/0063 | 162/193 |
| 5,155,921 A * | 10/1992 | Banike | B41F 27/02 | 33/618 |
| 6,199,280 B1 * | 3/2001 | Schneider | B41F 27/1206 | 101/415.1 |
| 7,565,856 B2 * | 7/2009 | Pfaff, Jr. | B26D 7/2628 | 83/698.42 |

(Continued)

FOREIGN PATENT DOCUMENTS

| | | |
|---|---|---|
| DE | 100 52 774 A1 | 5/2002 |
| DE | 102 56 236 A1 | 11/2003 |

(Continued)

OTHER PUBLICATIONS

International Search Report dated Dec. 15, 2015 in corresponding PCT International Application No. PCT/IB2015/057332.

(Continued)

*Primary Examiner* — Matthew G Marini
*Assistant Examiner* — Marissa Ferguson-Samreth
(74) *Attorney, Agent, or Firm* — Ostrolenk Faber LLP

(57) ABSTRACT

Apparatus (1) for changing a blade of a rotary die cutter, particularly for flexographic printing machines: a magnetic cylinder (3) configured to receive and support a die-cutting blade (5, 5'); a station (7) for inserting the blade (5, 5') has a retention device (70) configured to retain the blade (5) in the insertion station; a guiding device (71) guides the blade (5, 5') toward the magnetic cylinder (3); a station (9) for extracting the blade (5, 5'), has an extraction device (90) configured to remove the blade (5, 5') from the magnetic cylinder (3).

12 Claims, 12 Drawing Sheets

(52) U.S. Cl.
CPC ..... *B26F 1/44* (2013.01); *B41F 5/24* (2013.01); *B41G 7/006* (2013.01); *B26D 2007/2607* (2013.01); *B26F 2001/4463* (2013.01)

(58) Field of Classification Search
CPC ..... B41F 19/008; B26D 5/007; B26D 7/27; B26D 7/2614; B26D 2007/2607; B26F 1/44; B26F 2001/4463; B41G 7/006
See application file for complete search history.

(56) References Cited

U.S. PATENT DOCUMENTS

| | | | | |
|---|---|---|---|---|
| 7,614,328 | B2 * | 11/2009 | Perini | B65H 19/267 225/93 |
| 2007/0227379 | A1 * | 10/2007 | Sato | B41F 27/02 101/389.1 |

FOREIGN PATENT DOCUMENTS

| | | | |
|---|---|---|---|
| DE | 20 2004 018 763 | U1 | 3/2005 |
| DE | 10 2011 006 701 | A1 | 10/2012 |
| EP | 0 678 383 | A1 | 10/1995 |
| EP | 2 484 498 | A1 | 8/2012 |

OTHER PUBLICATIONS

Written Opinion dated Dec. 15, 2015 in corresponding PCT International Application No. PCT/IB2015/057332.

* cited by examiner

APPARATUS AND METHOD FOR CHANGING A BLADE OF A ROTARY DIE CUTTER, PARTICULARLY FOR FLEXOGRAPHIC PRINTING MACHINES

CROSS-REFERENCE TO RELATED APPLICATIONS

The present application is a 35 U.S.C. §§ 371 national phase conversion of PCT/IB2015/057332, filed Sep. 23, 2015, which claims priority of Italian Application No. MI2014A001654, filed Sep. 24, 2014, the contents of which are incorporated by reference herein. The PCT International Application was published in the English language.

TECHNICAL FIELD OF THE INVENTION

The present invention relates to an apparatus and a method for changing a blade of a rotary die cutter, particularly for flexographic and offset printing machines.

BACKGROUND OF THE INVENTION

It is known, in particular for flexographic printing, that there is a problem of replacing the rotary die cutters for variations in shape and size of labels or of any printed image to be die-cut.

At present, replacement of rotary die-cutters, for changing the blade to allow cutting-to-size of labels or printed images requires more or less prolonged machine downtimes, depending on the complexity of the replacement operations.

SUMMARY OF THE INVENTION

The main object of the present invention is to provide an apparatus and a method for changing a blade of a rotary die cutter to overcome drawbacks and the limitations of the prior art.

An object of the present invention is to provide an apparatus and a method which allow the blade of the rotary die cutter to be replaced in a more rapid and efficient manner.

Another object of the invention is to provide such an apparatus and a method which may also be completely automated.

Another object of the invention is to provide such an apparatus and a method which may be applied to any existing rotary die-cutting system.

Another object of the invention is to provide an apparatus and a method which allow different sequences of die-cutting operations to be obtained for different printing jobs using a single rotary die cutter.

A further object of the invention is to provide an apparatus and a method which provide greater guarantees in terms of reliability and safety during use.

Another object of the invention is to provide an apparatus which is easy and inexpensive to produce and a method which is competitive from an economic point of view when compared to the prior art.

The task described above, along with the objects mentioned and others which will appear more clearly below, are achieved by an apparatus for changing a blade of a rotary die cutter, particularly for flexographic printing machines. It comprises a magnetic cylinder configured to receive and support a blade, an insertion station for inserting said blade, comprising a retention device configured to retain said blade in said insertion station, and a guiding device configured to guide said blade toward said magnetic cylinder, and an extraction station for extracting said blade, comprising an extraction device configured to remove said blade from said magnetic cylinder.

The task described above, along with the objects mentioned and others which will appear below, are also achieved by a method for changing a blade of a rotary die cutter, particularly for flexographic printing machines, comprising:

- providing an apparatus for changing a blade of a rotary die cutter, comprising a magnetic cylinder configured to receive and support a blade, an insertion station for inserting said blade, and an extraction station for extracting said blade;
- in said extraction station, detaching and removing a first blade from said magnetic cylinder using an extraction device which cooperate with said magnetic cylinder made to rotate about its own rotation axis;
- inserting a second blade in said insertion station;
- guiding said second blade from said insertion station toward said magnetic cylinder;
- wrapping said second blade around said magnetic cylinder by means of rotation of said magnetic cylinder about its own rotation axis.

BRIEF DESCRIPTION OF THE DRAWINGS

Further characteristic features and advantages will become clearer from the description of a preferred, but non-exclusive embodiment of an apparatus for changing a blade of a rotary die cutter, illustrated by way of a non-limiting example with reference to the attached drawings.

DETAILED DESCRIPTION OF AN EMBODIMENT OF THE INVENTION

Figure 1:
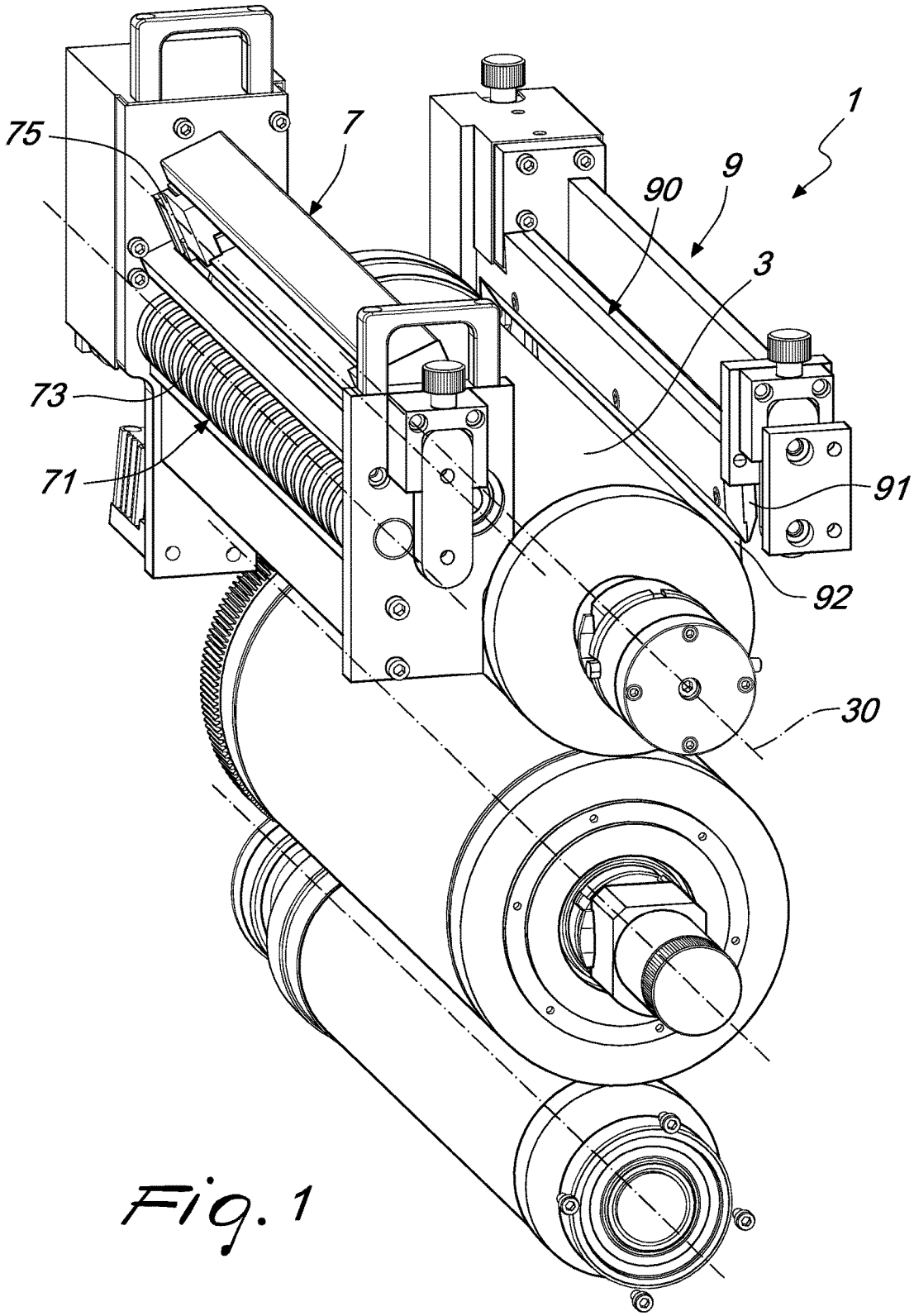
FIG. 1 is a perspective view of an embodiment of an apparatus, according to the invention.

With reference to the Figures, the apparatus for changing a blade of a rotary die cutter, particularly for flexographic printing machines, denoted overall by the reference number 1, comprises a magnetic cylinder 3, configured to receive and support a die-cutting blade 5, 5'.

The apparatus 1 comprises an insertion station 7 for inserting a blade 5, which comprises a retention device 70 configured to retain the blade 5 in the insertion station 7, and a guiding device 71 configured to guide the blade 5 from the insertion station 7 toward the magnetic cylinder 3.

The apparatus 1 comprises an extraction station 9 for extracting the blade 5, which comprises an extraction device 90 configured to remove the blade 5 from the magnetic cylinder 3.

Advantageously, the extraction device 90 comprises an oscillating body 91 which comprises an end 92 configured to detach the blade 5 from the magnetic cylinder 3. The oscillating body 91 oscillates in fact between an inactive configuration, in which an end 92 of the body is spaced from the magnetic cylinder 3, and therefore also from the blade 5 wrapped around the magnetic cylinder 3, and a removal configuration for removal of the blade 5, in which the end 92 of the oscillating body 91 is configured to engage the blade 5 and detach it from the magnetic cylinder 3.

Figure 2:
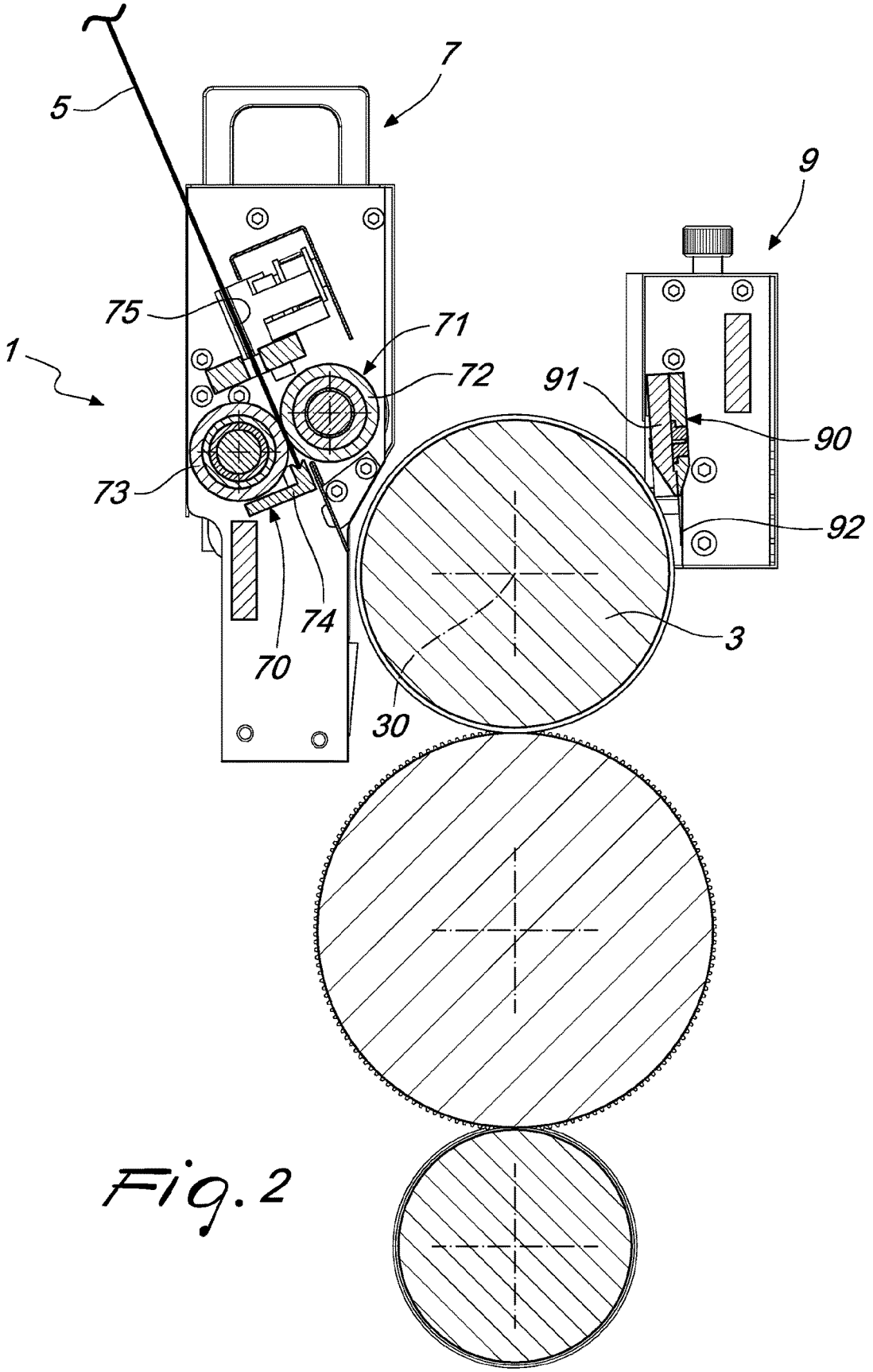
FIGS. 2 to 4 show a sequence of steps for application of a first blade of a rotary die cutter to a magnetic cylinder, by means of the apparatus according to the invention.
Figure 3:
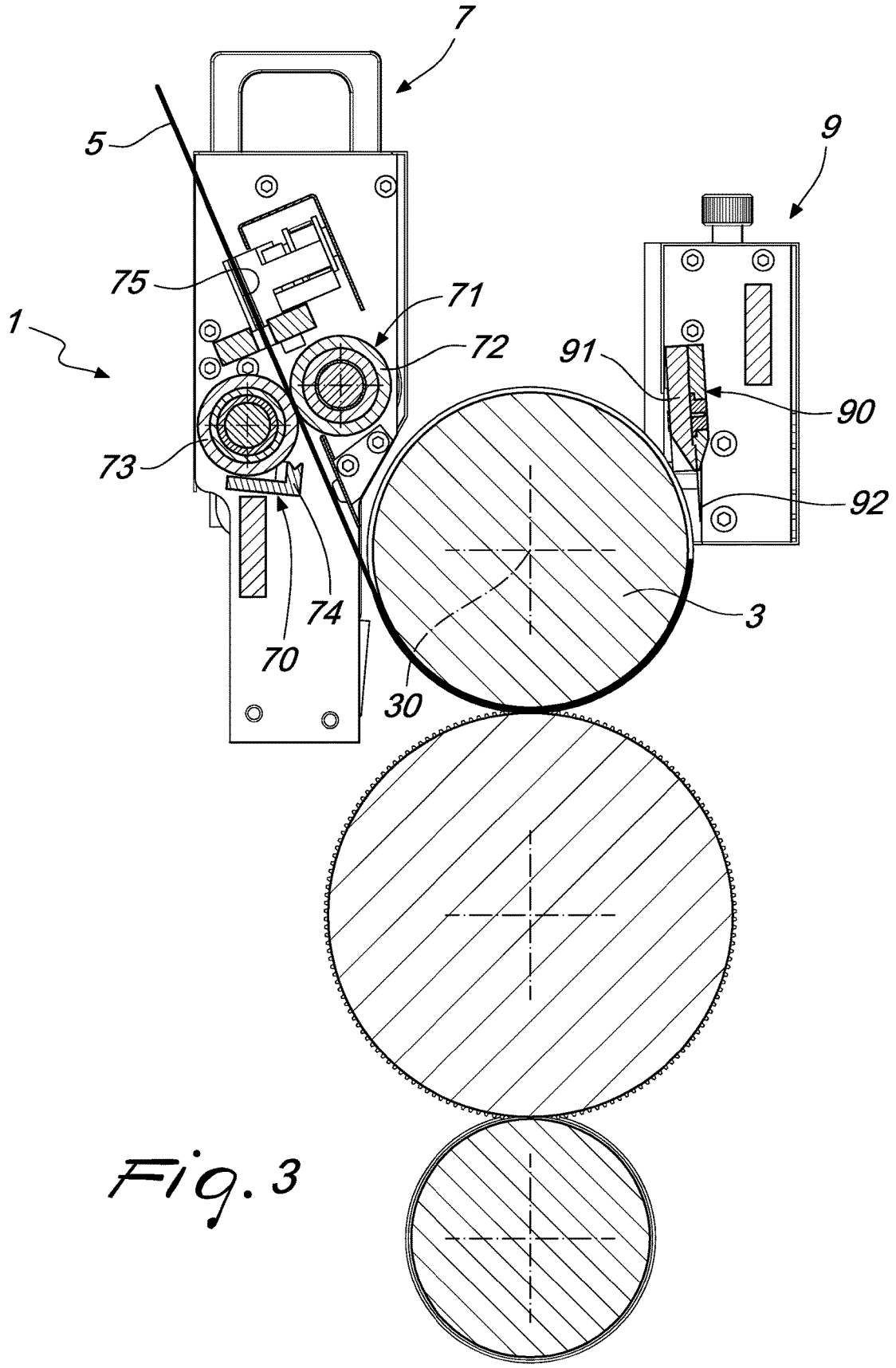
Figure 4:
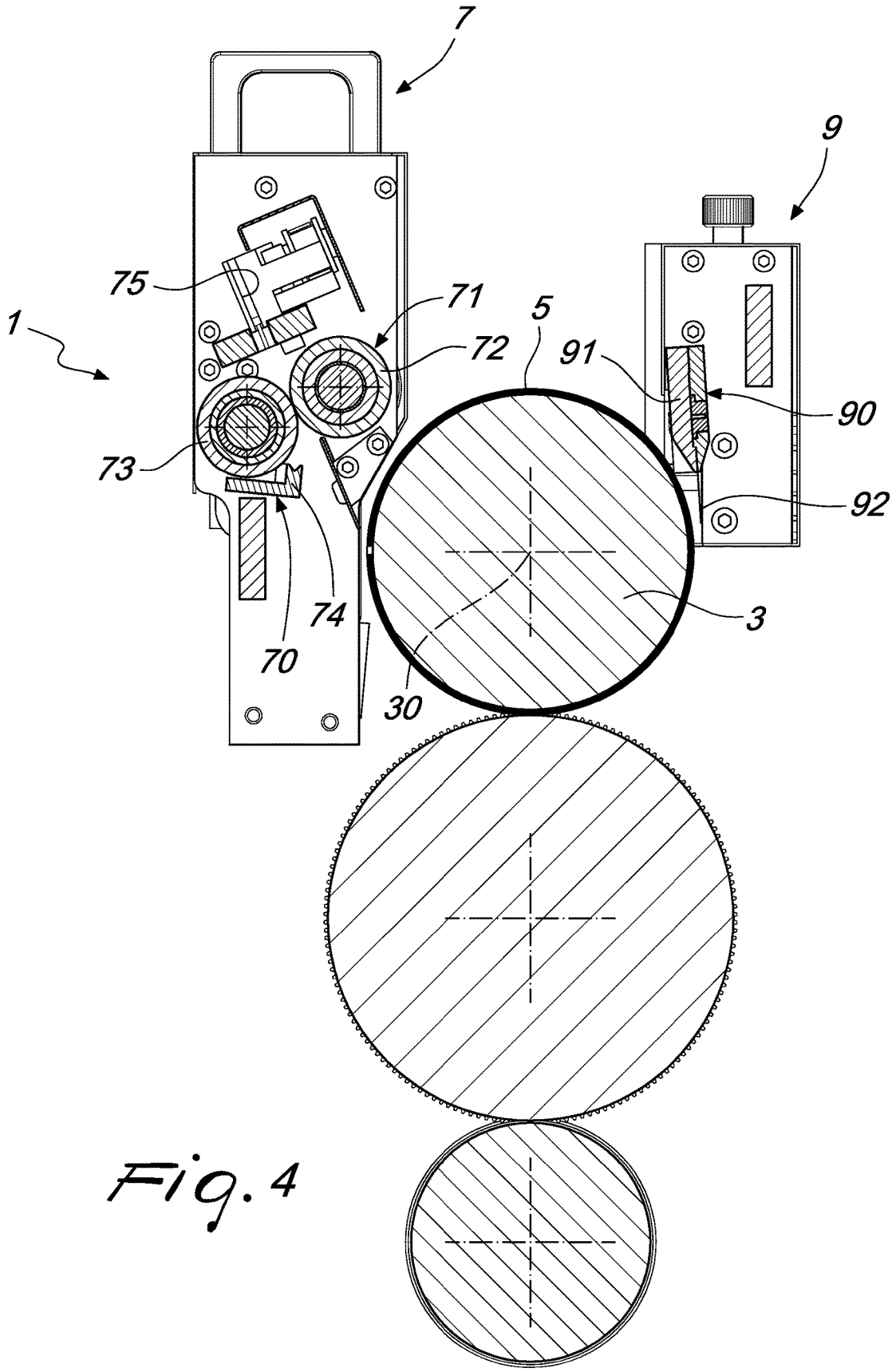
Figure 5:
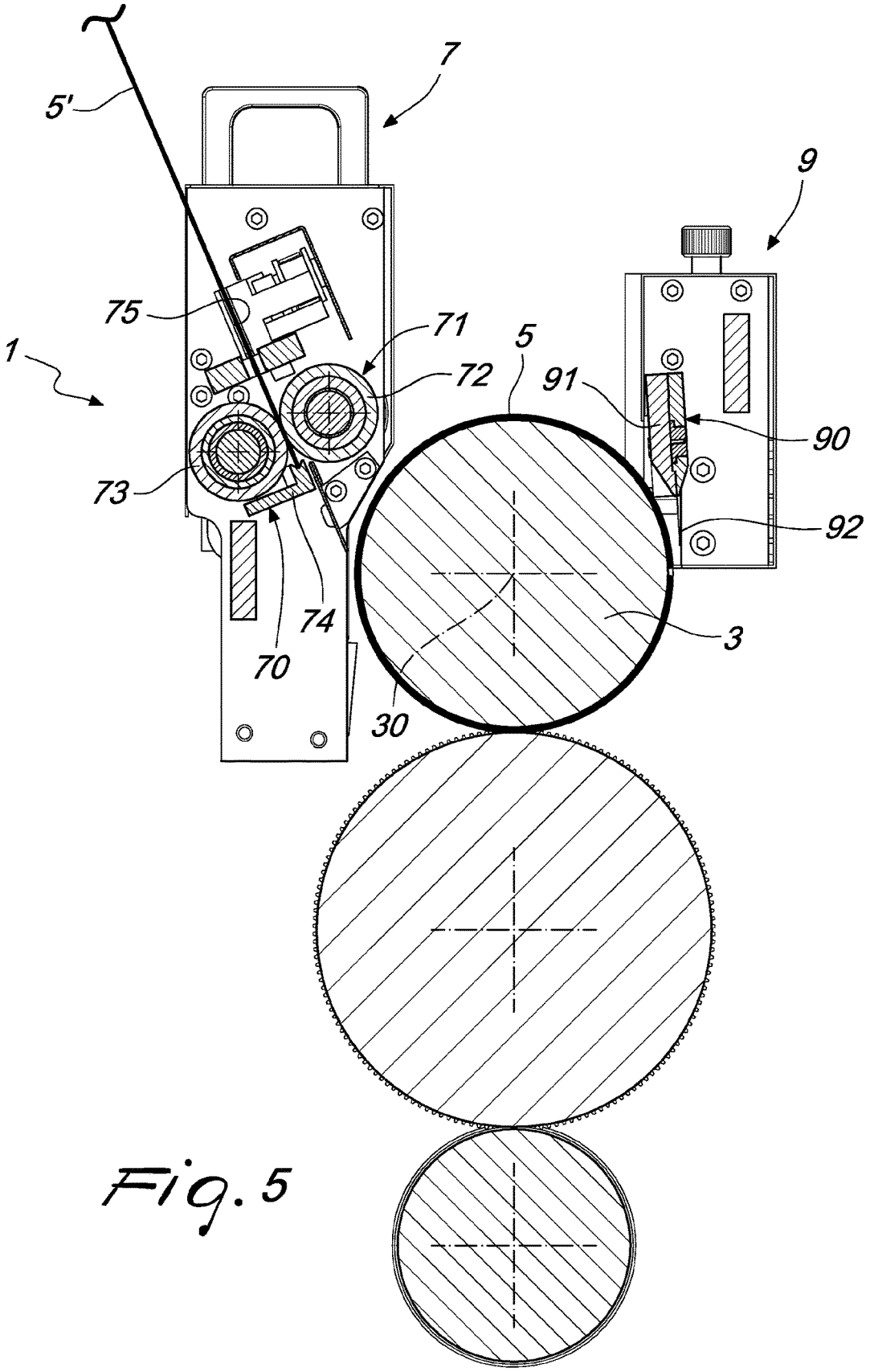
FIGS. 5 to 12 show a sequence of steps for replacing, on a magnetic cylinder, a first blade with a second blade, by means of the apparatus according to the invention.
Figure 6:
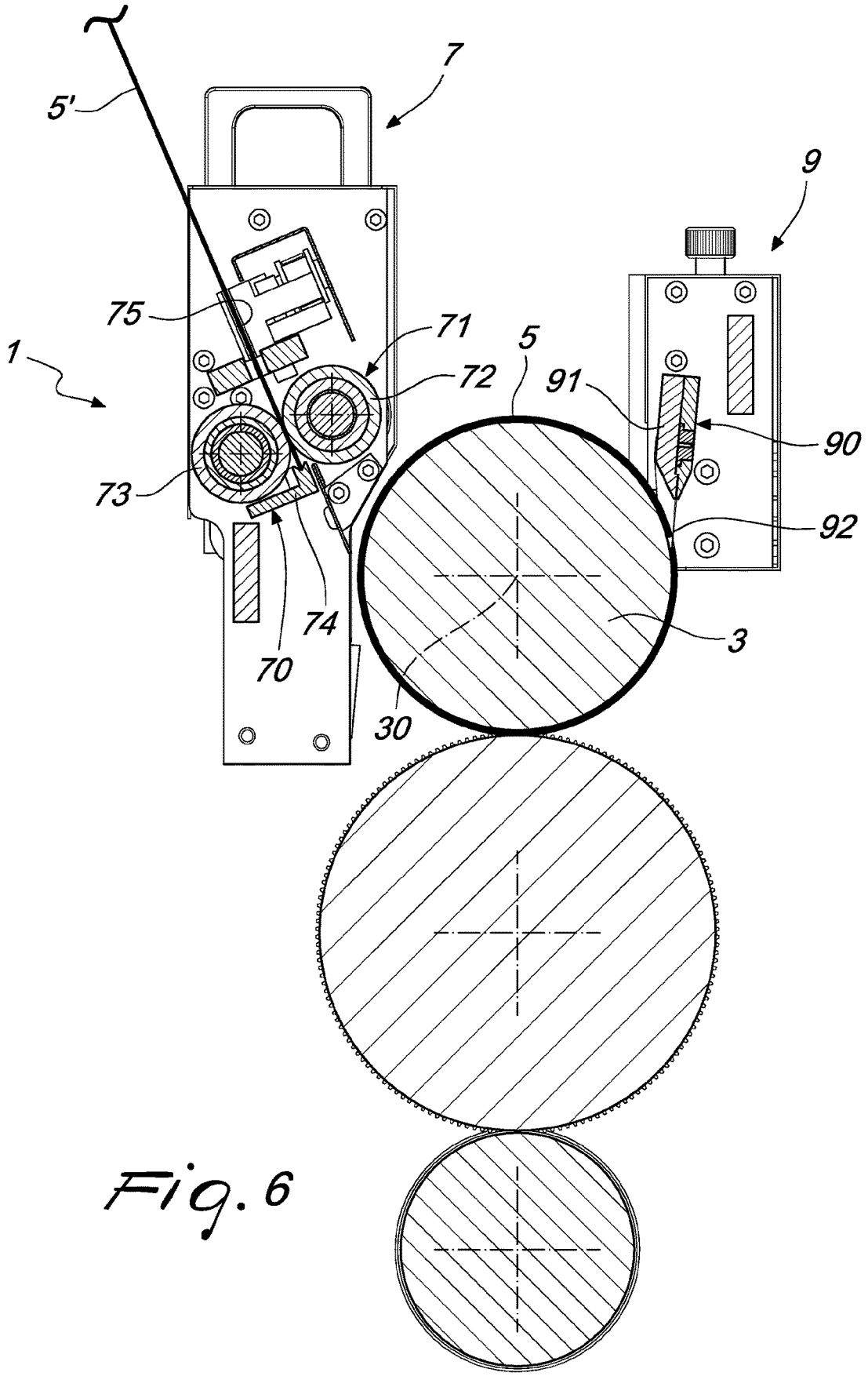
Figure 7:
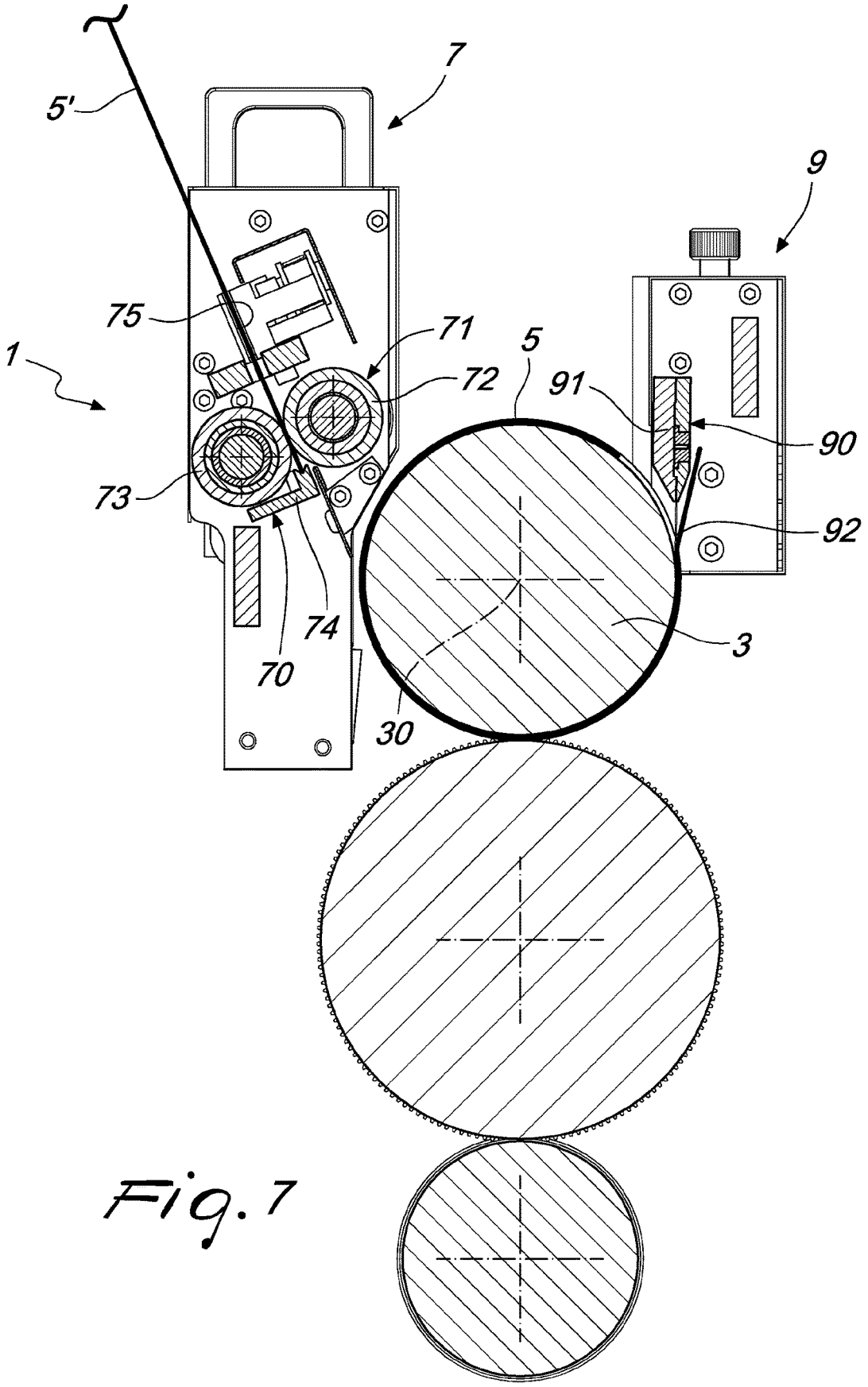
Figure 8:
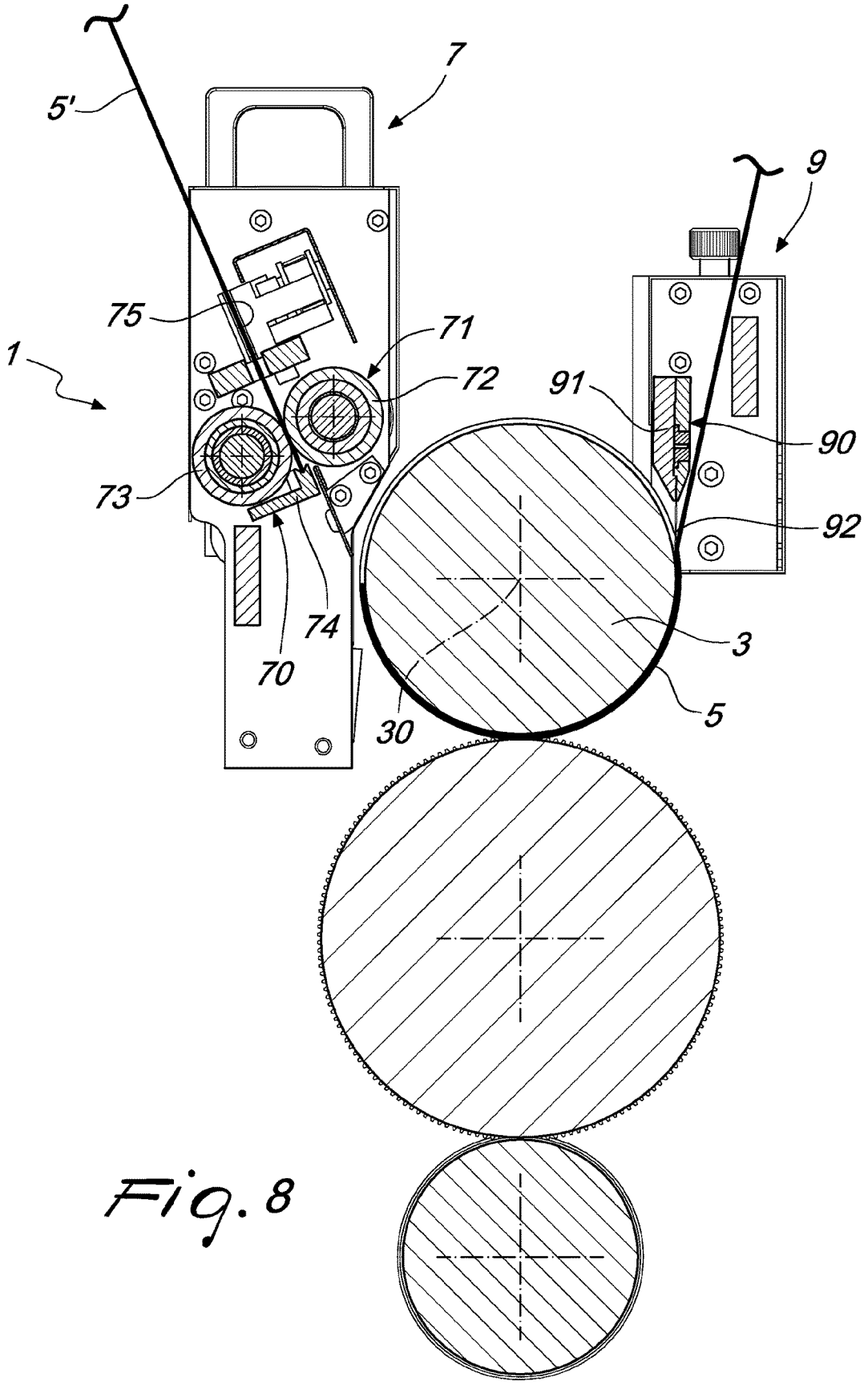
Figure 9:
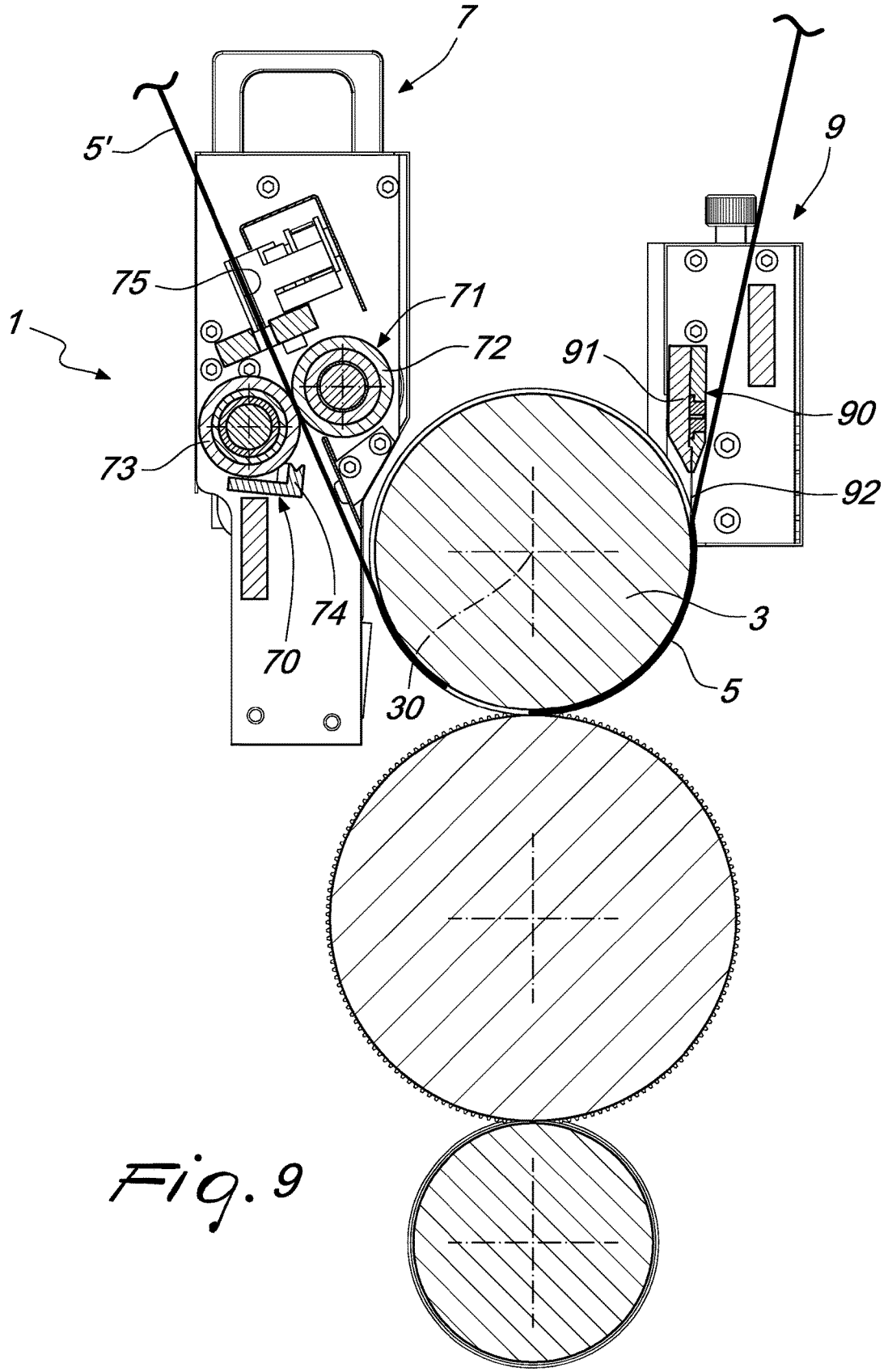
Figure 10:
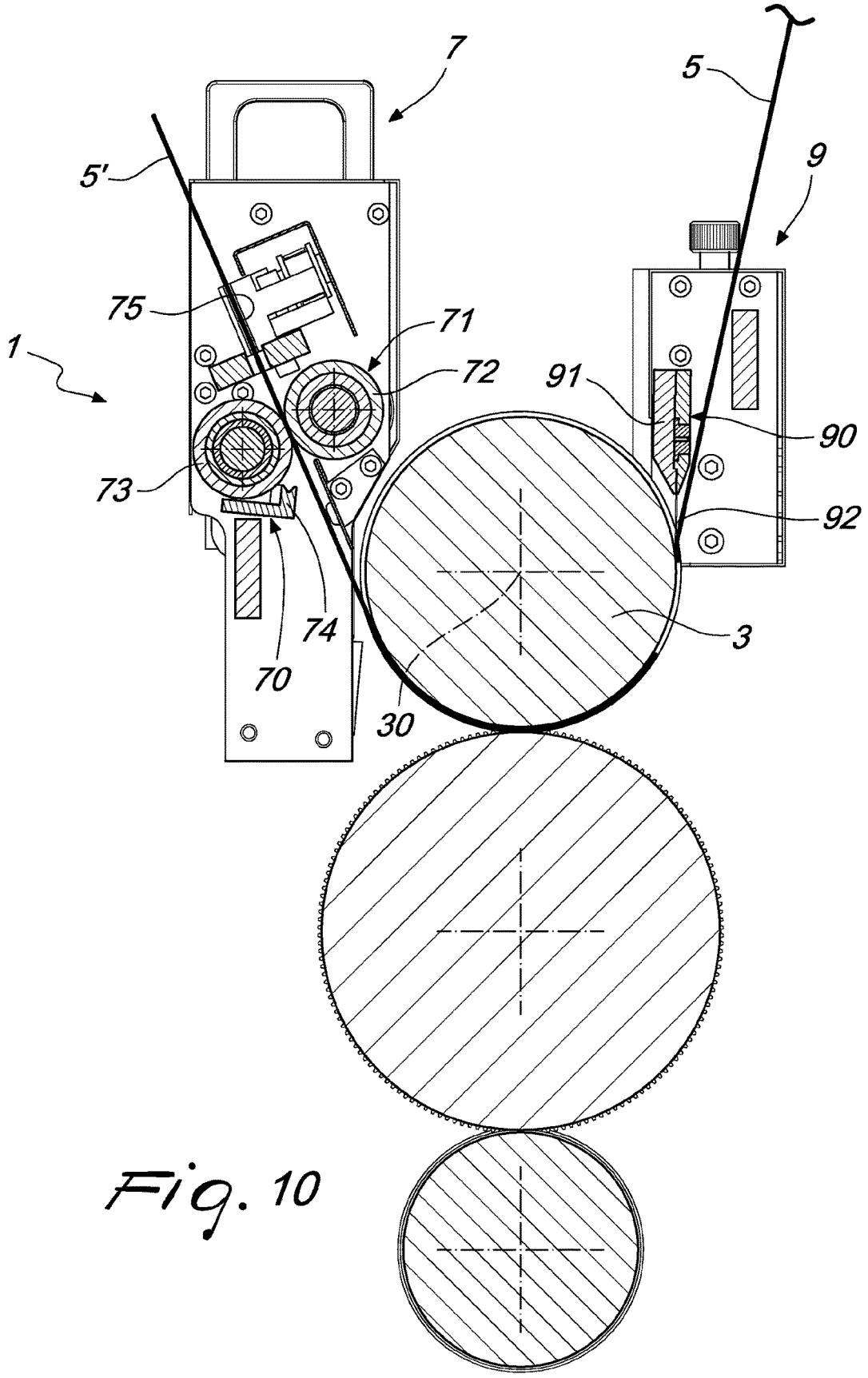
Figure 11:
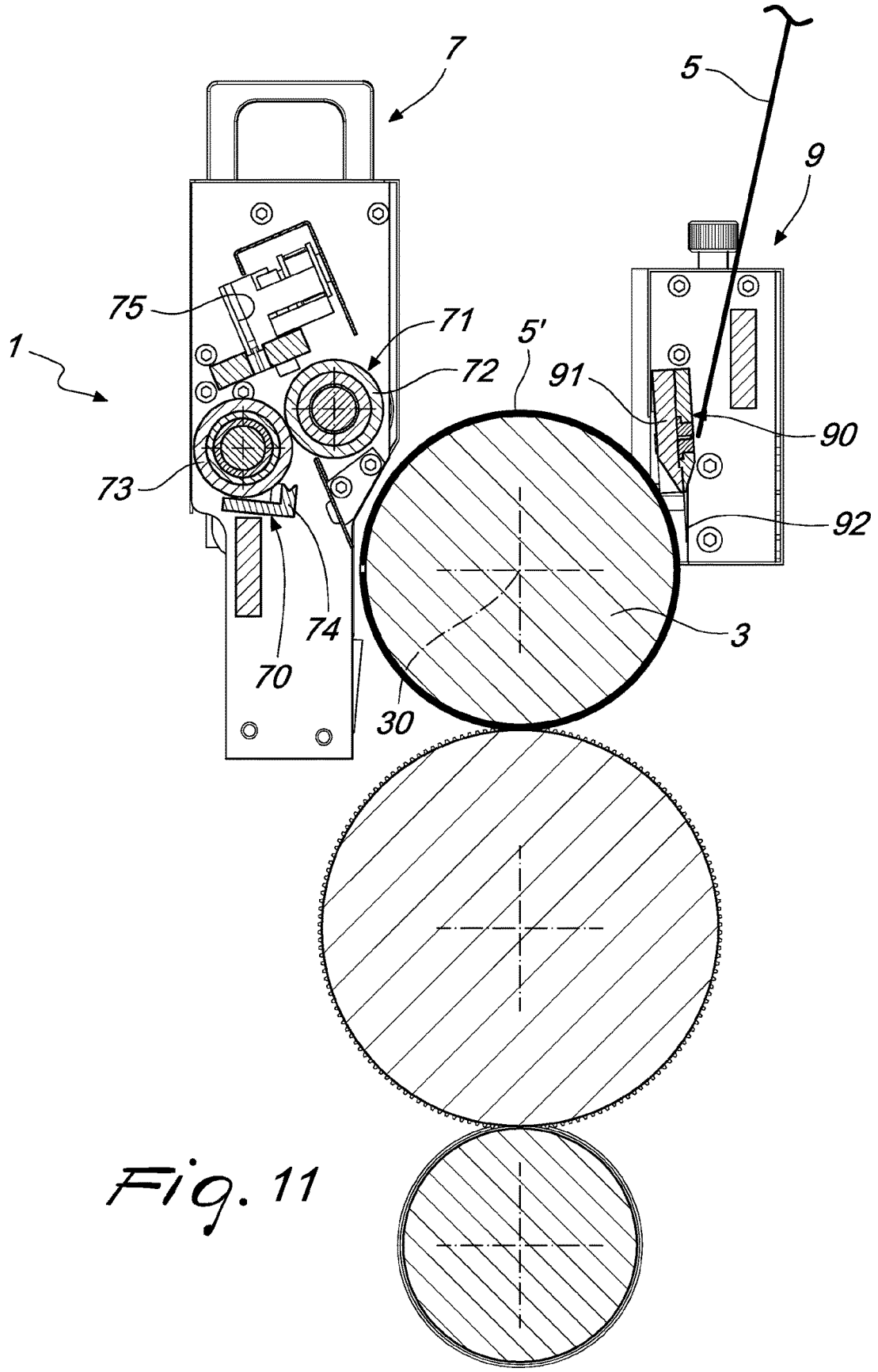
Figure 12:
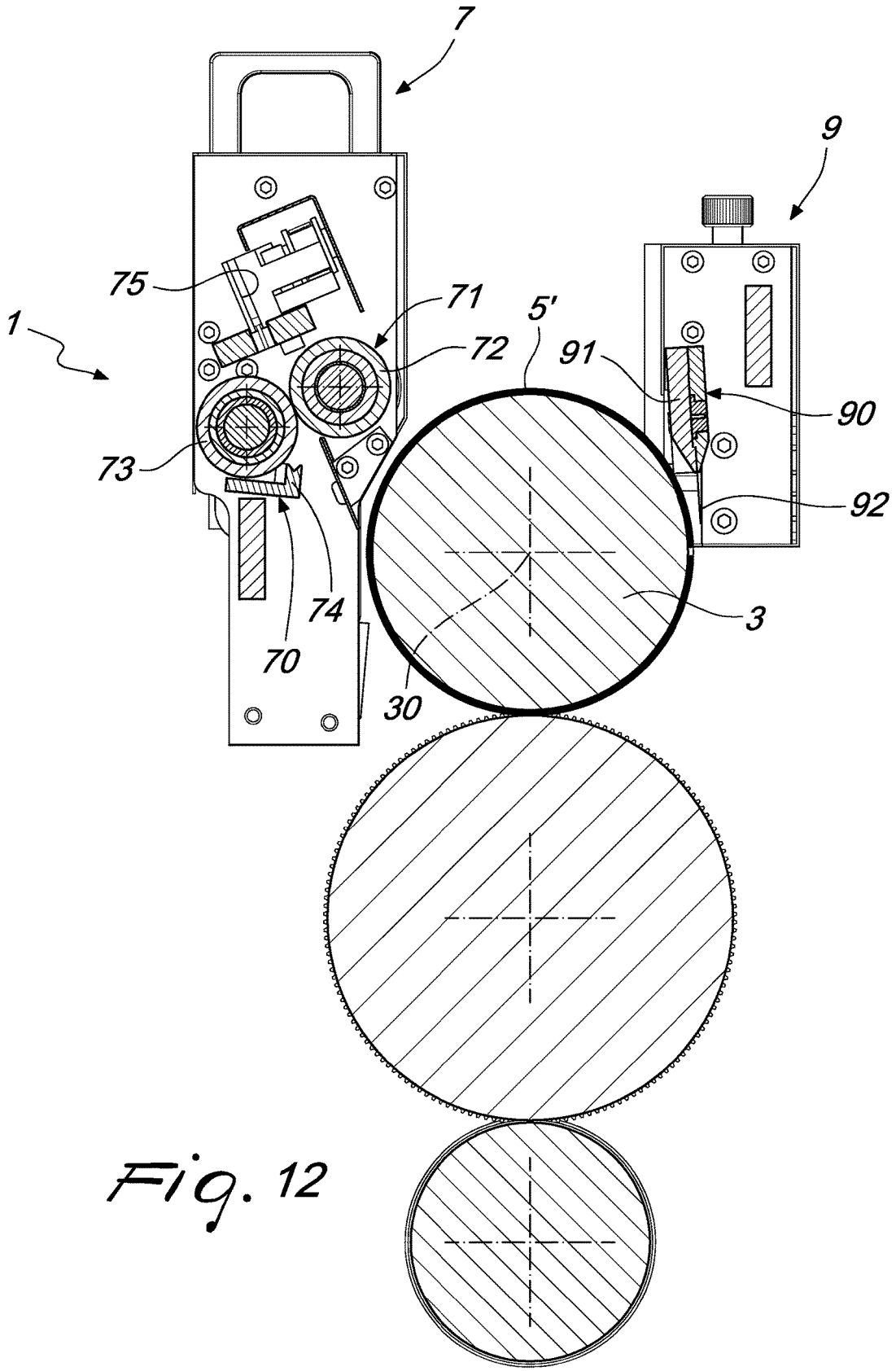

In FIGS. 2 to 5, 11 and 12, the oscillating body 91 is shown in its inactive configuration, while in FIGS. 6 to 10 the oscillating body is shown in the configuration for removal of the blade 5, 5'.

Advantageously, moreover, in the removal configuration, the end 92 of the oscillating body 91 is adapted to be inserted between the blade 5, 5' wrapped around the magnetic cylinder 3 and the magnetic cylinder 3 itself so that the rotation of the magnetic cylinder 3 about its rotation axis 30 causes detachment of the blade 5, 5' from the magnetic cylinder 3.

The blade 5, 5' has a size to enable the blade to be wrapped substantially around the whole lateral surface of the magnetic cylinder 3. As shown in particular in FIG. 6, oscillation of the extraction device 90 may be synchronized with the rotation of the magnetic cylinder 3 so that the oscillating body 91 is positioned in the configuration for removal of the blade 5, 5' precisely at the point where the ends of the blade 5 face each other. In this way it is possible to ensure that the end 92 of the oscillating body 91 is inserted between the blade 5, 5' and the magnetic cylinder 3, for causing detachment of the blade 5, 5' from said magnetic cylinder 3.

The oscillating body 91 is advantageously hinged on a portion of the extraction station 9 and may comprise an actuating device which causes oscillation of the oscillating body from the inactive configuration into the removal configuration, and vice versa.

Advantageously, the guiding device 71 comprises a pair of guiding cylinders 72, 73 which face each other and between which the blade 5, 5' is guided. Furthermore, the guiding device 71 may also comprise a sliding channel 75 for the blade 5, 5', adapted to seat the blade 5, 5' while it is on standby, waiting to be applied onto the magnetic cylinder 3.

Advantageously the retention device 70 comprises a retention arm 74 which can move between a retention configuration, in which the arm 74 is configured to support the blade 5, 5', and a release configuration, in which this arm 74 is configured to release the blade 5, 5' toward the magnetic cylinder 3. For example, in FIG. 2, the retention arm 74 is shown in the retention configuration, while in FIG. 3, it is shown in the release configuration. Advantageously, when the retention arm 74 is in the release condition, the blade 5,5' tends to slide downwardly, owing to the force of gravity, while being guided by the guiding device 71 until it is attracted, and made to rotate, by the magnetic cylinder 3. The retention device 70 comprises advantageously an actuating device which cause the displacement of the retention arm 74 from the retention configuration into the release configuration, and vice versa.

The method for changing a blade of a rotary die cutter, by means of the apparatus 1, comprises the steps of:

- in the extraction station 9, detaching and removing a first blade 5 from the magnetic cylinder 3 around which it is wrapped, using the extraction device 90 which cooperate, in order to perform detachment and removal of the blade 5, with the magnetic cylinder 3 made to rotate about its own rotation axis 30;
- inserting a second blade 5' in the insertion station 7;
- guiding the second blade 5' from the insertion station 7 toward the magnetic cylinder 3, via the guiding device 71, following deactivation of the retention device 70;
- wrapping the second blade 5' around the magnetic cylinder 3, by means of rotation of the magnetic cylinder 3 about its rotation axis 30.

Advantageously the step of detaching and removing the first blade 5 from the magnetic cylinder 3 comprises the step of engaging the first blade 5 and the step of detaching the first blade 5 from the magnetic cylinder 3 using the extraction device 90 which are configured to remove the first blade 5 from the magnetic cylinder 3, penetrating between the first blade 5 and the magnetic cylinder 3, together with rotation of the magnetic cylinder 3 about its rotation axis 30.

Advantageously, moreover, the method of changing a blade of a rotary die cutter comprises a step of automatic preparation of the blade 5, 5' in the insertion station 7. In this way, the blade 5' located in the insertion station 7 is ready to replace the blade 5 which will be detached and removed from the magnetic cylinder 3.

The method may also comprise a step of automatic storage of the blades 5, 5' exiting the extraction station 9.

Furthermore, the steps of detaching and removing the first blade 5 from the magnetic cylinder 3, guiding the second blade 5' toward the magnetic cylinder 3 and wrapping the second blade 5' around the magnetic cylinder 3 are advantageously automated.

Once the blade 5, 5' is positioned in the insertion station 7, it remains on standby waiting to be applied onto the magnetic cylinder 3. Insertion of the blade 5, 5' onto the magnetic cylinder 3 may be performed automatically, by means of a signal from the apparatus 1, or manually, by means of an operator. Owing to the retention device 70, which retain the blade 5, 5' in the insertion station 7, a blade 5, 5' can be inserted into the insertion station at any time so that the latter is ready, if necessary, to replace the blade which is momentarily applied to the magnetic cylinder 3. Activation of the extraction device 90 may also be automatic or manual.

Advantageously, operation of the retention device 70, the guiding device 71, the extraction device 90 and the actuating device for rotation of the magnetic cylinder 3 about its rotation axis 30 are synchronized so as to ensure correct insertion of the blade 5, 5' onto the magnetic cylinder 3 and correct removal of the blade 5, 5' from the magnetic cylinder 3 without damaging it.

Moreover change-over of the blade 5, 5' from the standby condition in the insertion station 7 to the operating condition on the magnetic cylinder 3 and then to the condition for expulsion via the extraction station 9 may be performed entirely automatically, depending on the series of operations to be performed by the die-cutting machine, or semi-automatically, in the case where there is an operator who sets the times for change-over from one working condition of the rotary die cutter to another.

Advantageously, moreover, automatic change-over from one die cutting condition to another is performed always on the same single magnetic cylinder so that it is possible to obtain different sequences of die-cutting operations for the different printing jobs using a single die-cutting machine.

The apparatus and the method for changing a blade of a rotary die cutter, according to the present invention, performs the task and also achieves the predefined objects since it allows changing of the blade rapidly, efficiently and also automatically.

Another advantage of the apparatus according to the invention consists in the fact that it may be applied to any existing rotary die-cutting system.

A further advantage of the apparatus and the method according to the invention consists in fact that replacement of the die-cutting blades is performed in a smooth, efficient and delicate manner.

The apparatus and the method for changing a blade of a rotary die cutter thus conceived may be subject to numerous modifications and variations all of which fall within the scope of the inventive idea.

Moreover, all the details may be replaced by other technically equivalent elements.

Basically, the materials used, provided that they are compatible with the specific use, as well as any incidental dimensions and forms may be of any nature depending on requirements.

The invention claimed is:

1. An apparatus for changing a blade of a rotary die cutter, comprising:

a magnetic cylinder configured to receive and support a blade wrapped around the magnetic cylinder, wherein the blade is magnetically attracted to the cylinder; the cylinder being rotatable in a rotation direction;

an insertion station configured for inserting the blade, the insertion station being at a first location around the cylinder;

the insertion station comprising a blade retention device configured to retain the blade in the insertion station, and a guiding device configured to guide the blade out of the insertion station and toward the magnetic cylinder where the blade is wrapped around the cylinder;

an extraction station configured for extracting the blade from the cylinder, the extraction station being at a second location around the cylinder, downstream in the rotation direction and spaced from the first location;

the extraction station comprising an extraction device configured to remove the blade from the magnetic cylinder, the extraction device comprising an oscillating body which includes an end configured to detach the blade from the magnetic cylinder, the oscillating body being configured to oscillate between an inactive configuration, in which an end of the oscillating body is spaced from the magnetic cylinder, and a removal configuration for removing the blade from the cylinder, in which the end of the oscillating body is configured to engage the blade and to detach the blade from the magnetic cylinder.

2. The apparatus according to claim 1, wherein in the removal configuration, the end of the oscillating body is configured to be inserted between the blade and the magnetic cylinder so that the rotation of the magnetic cylinder about an axis of the magnetic cylinder detaches the blade from the magnetic cylinder.

3. The apparatus according to claim 1, wherein the guiding device for guiding the blade comprises a pair of guiding cylinders that face each other and pass the blade between them.

4. The apparatus according to claim 1, wherein the blade retention device comprises a retention arm at the insertion station, the retention arm is movable between a retention configuration, in which the retention arm is configured to support the blade at the insertion station and away from the magnetic cylinder, and a release configuration, in which the retention arm is configured to release the blade out of the insertion station toward the magnetic cylinder.

5. The apparatus according to claim 4, further comprising a storage for the blade at the extraction station positioned to receive an extracted blade and configured to store the blade at the extraction station, whereby a blade can be stored at the insertion station and at the extraction station.

6. A flexographic printing apparatus including a rotary die cutter with a blade and an apparatus for changing the blade of the rotary die cutter according to claim 1.

7. A method for changing a blade of a rotary die cutter, comprising the steps of:

a. providing apparatus for changing a blade of a rotary die cutter, the apparatus comprising a magnetic cylinder configured to receive and support a blade, an insertion station configured for insertion of the blade onto the magnetic cylinder and an extraction station configured for extracting the blade from the magnetic cylinder;

b. rotating the magnetic cylinder about its own rotation axis in a rotation direction;

c. the extraction station being spaced downstream from the insertion station in the rotation direction; in the extraction station, detaching and removing a first blade from the magnetic cylinder by an extraction device that cooperates with the rotating magnetic cylinder and with the first blade around the cylinder;

d. inserting a second blade in the insertion station;

e. guiding the second blade from the insertion station toward the magnetic cylinder; and f. wrapping the second blade around the magnetic cylinder by the rotation of the magnetic cylinder about its own rotation axis;

the step of detaching and removing the first blade from the magnetic cylinder comprises engaging the first blade and detaching the first blade from the magnetic cylinder by an extraction device at the extraction station and the extraction device is configured to remove the first blade from the magnetic cylinder, by penetrating between the first blade and the magnetic cylinder.

8. The method according to claim 7, further comprising automatically preparing the first blade in the insertion station.

9. The method according to claim 7, further comprising automatically storing the blade at exit thereof from the extraction station.

10. The method according to claim 7, further comprising the detaching and removing of the first blade from the magnetic cylinder, the guiding of the second blade toward the magnetic cylinder and the wrapping of the second blade around the magnetic cylinder are automated.

11. A method in a flexographic printing apparatus, wherein the printing apparatus includes a rotary die cutter with a blade, the method including changing the blade of the rotary die cutter according to the method of claim 7.

12. The method of claim 7, wherein the step of detaching and extracting the first blade comprising positioning an end of an oscillating body between the blade and the magnetic cylinder and detaching the first blade by the end of the body.

* * * * *